United States Patent [19]

Dakin

[11] Patent Number: 4,783,615

[45] **Date of Patent: * Nov. 8, 1988**

[54] ELECTRODELESS HIGH PRESSURE SODIUM IODIDE ARC LAMP

[75] Inventor: James T. Dakin, Schenectady, N.Y.

[73] Assignee: General Electric Company, Schenectady, N.Y.

[ * ] Notice: The portion of the term of this patent subsequent to Aug. 12, 2003 has been disclaimed.

[21] Appl. No.: 749,025

[22] Filed: Jun. 26, 1985

[51] Int. Cl.[4] ..... H01J 17/20; H05B 41/16

[52] U.S. Cl. ..... 315/248; 315/241 R; 313/638; 313/639; 313/642

[58] Field of Search ..... 315/248, 225, 341; 313/638, 639, 642, 571, 116

[56] References Cited

U.S. PATENT DOCUMENTS

| | | | |
|---|---|---|---|
| 3,227,923 | 1/1966 | Marrison | 315/248 |
| 3,230,422 | 1/1966 | Gourber et al. | 315/248 |
| 3,234,421 | 2/1966 | Reiling | 313/25 |
| 3,319,119 | 5/1967 | Rendina | 315/248 |
| 3,323,010 | 5/1967 | Bisjak et al. | 315/248 |
| 3,351,798 | 11/1967 | Bauer | 313/225 |
| 3,717,782 | 2/1973 | Yamamoto et al. | 313/161 |
| 3,742,281 | 6/1973 | McInally | 315/248 |
| 3,763,392 | 10/1973 | Hollister | 315/248 |
| 3,860,854 | 1/1975 | Hollister | 315/248 |
| 4,605,881 | 8/1986 | Dakin | 313/638 |

FOREIGN PATENT DOCUMENTS 45-36257 11/1970 Japan .

OTHER PUBLICATIONS

D. D. Hollister, "A Xenon Lamp with Two Less Electrodes", *Electro-Optical Systems Design,* Feb. 1971, pp. 26–30.

U.S. patent application Ser. No. 454,225, of P. Johnson, filed Dec. 29, 1982.

U.S. patent application Ser. No. 676,367, of Dakin and Johnson, filed Nov. 29, 1984.

*Primary Examiner*—David K. Moore
*Assistant Examiner*—Michael Razave
*Attorney, Agent, or Firm*—Marvin Snyder; James C. Davis, Jr.

[57] ABSTRACT

High pressure xenon is used as a buffer gas in an electrodeless sodium iodide arc lamp. Very high efficacies are achieved by using an arc tube with rounded edges and by surrounding a portion of the arc tube with quartz wool. The arc tube may also contain small amounts of mercury iodide.

10 Claims, 1 Drawing Sheet

ELECTRODELESS HIGH PRESSURE SODIUM IODIDE ARC LAMP

BACKGROUND OF THE INVENTION

The present invention relates in general to high efficacy, high pressure metal halide arc discharge lamps and more specifically to the use of xenon buffer gas at high pressure in an electrodeless sodium iodide arc lamp.

In copending application Ser. No. 676,367, now U.S. Pat. No. 4,605,881, of Dakin and Johnson, filed Nov. 29, 1984 and assigned to the assignee of the present invention, an arc lamp containing sodium iodide and xenon buffer gas is disclosed. This copending application, Ser. No. 676,367, is hereby incorporated by reference. The prior application teaches that one form of high intensity discharge lamp that is currently and conventionally employed is the metal halide lamp. In such lamps the arc discharge tube includes a metal halide, such as sodium iodide, which is vaporized and dissociated in the plasma arc during lamp operation. However, in the vicinity of the arc tube walls, where the temperature is cooler, sodium remains chemically bound to the iodide preventing the sodium from absorbing some of the light radiation. Without the added halide, the self-absorption characteristics of cooler sodium atoms distributed preferentially near the cooler arc tube walls would act to limit lamp efficacy. In particular, sodium D-line radiation produced within the hot central plasma region of the arc tube would be readily absorbed by the cooler sodium atoms which would be present near the arc tube walls.

While the addition of halides to the lamp reduces the presence of free sodium near the cooler arc tube walls, it also requires a buffer gas to limit the transport of energy from the hot core of the arc to the arc tube walls via chemical reaction. The conventional use of mercury to buffer the chemical transport of energy from the plasma arc to the arc tube walls requires very high mercury pressures. However, the use of high pressure mercury asymmetrically broadens the sodium D-line on the red side, enhancing non-efficacious radiation output. Further reduction of observed efficacy is presumed to be caused by the tying-up of iodine by the large excess of mercury buffer gas, especially in the cooler parts of the arc tube where mercury iodide is stable.

By using xenon buffer gas rather than mercury, the electroded lamp in application Ser. No. 676,367 realizes a favorable influence on the sodium D-line spectrum as well as the prevention of the tie-up of halide by the buffer gas. Although very good results are achieved by using the sodium iodide-xenon fill in an electroded lamp, efficacy is limited by the end losses inherent in electroded lamps. The electrical end losses of an electroded lamp depend on the lamp's electrode voltage. The amount of end losses are affected by the shape and size of the arc tube. End losses with a short, wide arc tube are large compared to a long, narrow arc tube. In contrast, the arc efficacy in a short, wide arc tube is better than in a long, narrow one. Thus, the electroded lamp does not optimize well.

OBJECTS OF THE INVENTION

It is a principal object of the present invention to buffer chemical transport of energy from the plasma arc to the arc tube walls in an electrodeless sodium iodide arc discharge lamp with xenon buffer gas.

It is another object of the present invention to prevent tie-up of halide by the buffer gas in an electrodeless sodium iodide arc discharge lamp.

It is yet another object of the present invention to improve the efficacy of the electrodeless arc discharge lamp.

It is still another object of the invention to optimize the performance of an electrodeless sodium iodide-xenon arc lamp.

SUMMARY OF THE INVENTION

These and other objects are achieved by the disclosed fill in an electrodeless sodium iodide arc lamp for supporting a plasma discharge, the fill comprising sodium iodide, mercury iodide, and xenon in a sufficient quantity to limit chemical transport of energy from the plasma discharge to the walls of the arc tube. In particular, the fill comprises mercury iodide in a quantity less than the quantity of sodium iodide, the quantity of mercury iodide being sufficient to provide an amount of free iodine near the arc tube walls when the lamp is operating. The sodium iodide may also be present in an quantity which provides a reservoir of condensate during lamp operation.

In another aspect of the present invention, an electrodeless metal halide arc discharge lamp comprises a light-transmissive arc tube for containing an arc discharge and a fill disposed in the arc tube. The fill includes sodium iodide and xenon. The lamp further comprises excitation means for coupling radio-frequency energy to the fill.

BRIEF DESCRIPTION OF THE DRAWINGS

The novel features of the invention are set forth with particularity in the appended claims. The invention itself, however, as to organization and method of operation, together with further objects and advantages thereof, may best be understood by reference to the following description taken in conjunction with the accompanying drawings in which:

DETAILED DESCRIPTION OF THE INVENTION

Figure 1:
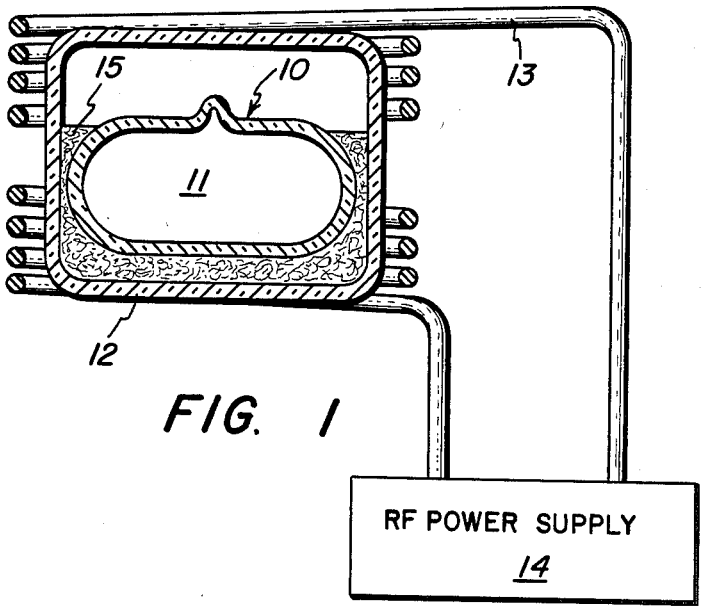
FIG. 1 is a side, cross-sectional view of the electrodeless lamp of the present invention and apparatus for exciting the lamp fill.

Referring to FIG. 1, an electrodeless arc discharge lamp includes an arc tube 10 for containing a fill 11. Arc tube 10 comprises a light-transmissive material such as fused quartz or a refractory ceramic material, e.g. sintered polycrystalline alumina. One possible shape for arc tube 10 may be described as a flattened spherical shape or as a short cylindrical shape (eg. a hockey puck or pill box) with rounded edges. The major diameter of arc tube 10 may be about 5 centimeters, for example.

An outer envelope 12 is disposed around arc tube 10. Outer envelope 12 is light-transmissive and may also be comprised of quartz or a refractory ceramic. Convective cooling of arc tube 10 is limited by outer envelope 12. A blanket of quartz wool 15 may also be provided between arc tube 10 and outer envelope 12 to further limit cooling.

A primary coil 13 and a radio-frequency (RF) power supply 14 are employed to excite a plasma arc discharge in fill 11. This configuration of primary 13 and RF power supply 14 is known in the art and is commonly referred to as a high intensity discharge solenoidal electric field (HID-SEF) lamp. The SEF configuration is essentially a transformer which couples radio-frequency energy to a plasma, the plasma acting as a single-turn secondary. A changing with time magnetic field which results from current in primary coil 13 creates an electric field in arc tube 10 which closes upon itself completely. Current flows as a result of the electric field and an arc discharge results in arc tube 10. HID-SEF lamp structures are the subject matter of U.S. Pat. No. 4,017,764 and U.S. Pat. No. 4,180,763, both issued to J. M. Anderson and assigned to the assignee of the present invention. Both patents are hereby incorporated by reference. An exemplary frequency of operation for RF power supply 14 is 13.56 megahertz. Typical power input to the lamp may be up to about 1200 watts.

Turning now to the contents of arc tube 10, fill 11 includes sodium iodide and xenon buffer gas. The amount of sodium iodide in fill 11 should be sufficient to achieve a sodium partial pressure within the arc discharge (lamp at full operating temperature) of about 10 to 100 torr. It is also preferable to provide enough sodium iodide so that a reservoir of sodium iodide condensate results even while the lamp is operating. In an arc tube having a volume of about 40 cc, the vaporization of 5 mg of NaI results in a sodium partial pressure of about 100 torr. Less than 5 mg of NaI results in a lower sodium pressure and no condensate. More than 5 mg of NaI results in a reservoir of condensate about equal to the excess over 5 mg. A typical partial pressure of xenon buffer gas is 200 torr at room temperature. The chemical inertness, high excitation and ionizing potentials, high atomic weight and large cross section for atom-to-atom collisions of xenon result in high efficacy for sodium iodide arc discharge lamps. The use of high pressure xenon buffer gas results in an improved sodium-iodine atomic ratio throughout the plasma arc so as to facilitate molecular bonding to form sodium iodide, with reduced free atomic sodium near the arc tube walls, which are at cooler temperatures.

A further reduction of atomic sodium can be realized by adding a small amount of mercury iodide to fill 11. During lamp operation, the mercury iodide dissociates. The resulting free iodine will then combine with any free sodium near the arc tube walls.

Further optimization of the lamp of the present invention is obtained through the use of quartz wool in the space between arc tube 10 and outer envelope 12. Quartz wool 15 is comprised of thin fibers of quartz which are nearly transparent to visible light but which diffusely reflect infrared. The preferred arrangement of quartz wool 15 is at the bottom and sides of arc tube 10. This arrangement reduces heat loss from arc tube 10, thus raising the arc tube wall temperature and the fill vapor pressures. The preferred thickness for the blanket of quartz wool 15 corresponds to that of which the outline of arc tube 10 just barely remains visible.

Figure 2A:
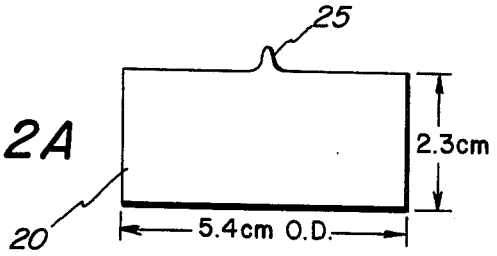
FIGS. 2A, 2B and 2C are cross-sectional views of differently shaped arc tubes for an electrodeless lamp.
Figure 2B:
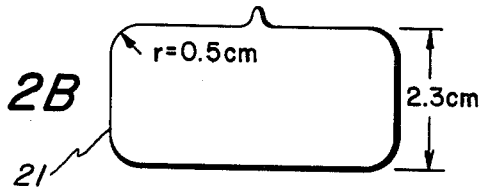
Figure 2C:
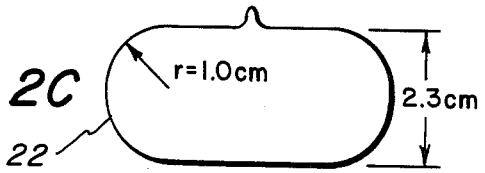

Turning now to FIGS. 2A–2C, a variety of shapes for arc tube 10 are shown, each with an outside diameter of 5.4 centimeters and a height of 2.3 centimeters. Thus, arc tube 20 has no edge curvature, arc tube 21 has a small amount of edge curvature, and arc tube 22 has edges which are completely rounded. It was found that arc tubes with increasingly rounded edges have slightly higher efficacies. Nib 25 results from the manufacturing process of the arc tubes.

The following examples demonstrate successfully tested lamps constructed according to the present invention.

EXAMPLE I

Arc tube 10 had an outside diameter of 5.4 cm, a height of 3.0 cm and had rounded edges. It was filled with 85 milligrams of NaI, 2.0 mg of $HgI_2$ and 200 torr of xenon (at room temperature). This lamp produced a luminous efficacy of 208 lumens per watt at an input power of 1225 watts.

EXAMPLE II

Arc tube 10 had an outside diameter of 5.4 cm, a height of 2.4 cm and rounded edges. It was filled with 63 mg of NaI, 1.5 mg of $HgI_2$ and 118 torr of xenon. This lamp produced 190 lumens per watt at 1000 watts.

EXAMPLE III

Arc tube 10 had the same size and shape as in Example II, but was filled with 109 mg of NaI and 204 torr of xenon. Efficacy was 200 lumens per watt at 1060 watts.

EXAMPLE IV

Arc tube 10 had an outside diameter of 5.4 cm, a height of 2.2 cm and the corners were not rounded. It was filled with 65 mg of NaI, 1.5 mg of $HgI_2$ and 200 torr of xenon. Efficacy was 196 lumens per watt at 1220 watts.

EXAMPLE V

Arc tube 10 had an outside diameter of 5.4 cm, a height of 2.1 cm and rounded edges. It was filled with 65 mg of NaI, 1.5 mg of $HgI_2$ and 300 torr of xenon. Efficacy was 196 lumens per watt at 1210 watts.

The foregoing describes an electrodeless sodium iodide arc lamp and a fill for such lamp wherein xenon is chosen as the buffer gas. Thus, tie-up of halide is prevented and efficacy is improved through use of xenon buffer gas which also results in a favorably influenced sodium D-line spectrum. The lamp achieves very high efficacies in the range of 200 lumens per watt by optimizing the arc tube shape and by preventing heat loss from the arc tube.

While preferred embodiments of the present invention have been shown and described herein, it will be obvious that such embodiments are provided by way of example only. Numerous variations, changes and substitutions will occur to those skilled in the art without departing from the invention herein. Accordingly, it is intended that the appended claims cover all such changes and modifications as fall within the spirit of the invention.

What is claimed is:

1. In an electrodeless metal halide arc lamp having an arc tube for containing an arc discharge, an arc tube fill for producing high luminous efficacy, said fill consisting essentially of:

sodium iodide present in a quantity which provides a reservoir of sodium iodide condensate during lamp operation;

xenon in a sufficient quantity to provide a partial pressure in the range of about 100 torr and higher at room temperature and to limit the chemical transport of energy from said arc discharge to the walls of said arc tube; and mercury iodide in a quantity less than the quantity of said sodium iodide and in a sufficient quantity to provide an amount of free iodine near said arc tube walls during lamp operation.

2. An electrodeless metal halide arc lamp of high luminous efficacy, comprising:

a light-transmissive arc tube for containing an arc discharge; and a fill disposed in said arc tube, said fill consisting essentially of sodium iodide present in a quantity which provides a reservoir of sodium iodide condensate during lamp operation and xenon, said xenon being present in a sufficient quantity to provide a partial pressure in the range of about 100 torr and higher at room temperature and to limit the chemical transport of energy from said arc discharge to the walls of said arc tube.

3. The lamp of claim 2 further comprising excitation means for coupling radio-frequency energy to said fill.

4. The lamp of claim 2 wherein said fill further consists of mercury iodide in a quantity less than the quantity of said sodium iodide and in a sufficient quantity to provide an amount of free iodine near said arc tube walls during lamp operation.

5. The lamp of claim 2 wherein said arc tube is cylindrically shaped, the height of said arc tube being less than its outside diameter, said arc tube further having rounded edges.

6. The lamp of claim 5 further comprising a light-transmissive outer envelope disposed around said arc tube and defining a space therebetween.

7. The lamp of claim 6 wherein said space is evacuated.

8. The lamp of claim 6 further including quartz wool disposed in at least a portion of said space.

9. The lamp of claim 8 wherein said quantity of xenon is sufficient to provide a partial pressure in the range of about 100 torr and higher at room temperature, said fill further consisting of a quantity of mercury iodide.

10. The lamp of claim 9 further comprising excitation means for coupling radio-frequency energy to said fill.

* * * * *

UNITED STATES PATENT AND TRADEMARK OFFICE

CERTIFICATE OF CORRECTION

PATENT NO. : 4,783,615

DATED : November 8, 1988

INVENTOR(S) : James T. Dakin

It is certified that error appears in the above-identified patent and that said Letters Patent is hereby corrected as shown below:

On the title page Item (75) add as joint inventors:

-- John M. Anderson, Schenectady, N.Y. and
Ashok K. Bhattacharya, Lyndhurst, Ohio - .

Signed and Sealed this

Twenty-eighth Day of March, 1989

*Attest:*

DONALD J. QUIGG

*Attesting Officer*

*Commissioner of Patents and Trademarks*